US010321796B2

(12) United States Patent
Son et al.

(10) Patent No.: US 10,321,796 B2
(45) Date of Patent: Jun. 18, 2019

(54) VACUUM CLEANER

(71) Applicant: LG ELECTRONICS INC., Seoul (KR)

(72) Inventors: Jungkyu Son, Seoul (KR); Bohyun Nam, Seoul (KR); Jaeyong Park, Seoul (KR); Sehwan Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/445,508

(22) Filed: Feb. 28, 2017

(65) Prior Publication Data

US 2017/0245718 A1 Aug. 31, 2017

(30) Foreign Application Priority Data

Feb. 29, 2016 (KR) ..... 10-2016-0024022

(51) Int. Cl.

| | |
|---|---|
| ***A47L 9/28*** | (2006.01) |
| ***A47L 5/36*** | (2006.01) |
| ***A47L 9/00*** | (2006.01) |
| ***A47L 9/10*** | (2006.01) |
| ***A47L 9/14*** | (2006.01) |
| ***A47L 9/24*** | (2006.01) |
| ***A47L 9/32*** | (2006.01) |

(52) U.S. Cl.

CPC ..... *A47L 9/2884* (2013.01); *A47L 5/362* (2013.01); *A47L 9/009* (2013.01); *A47L 9/102* (2013.01); *A47L 9/1409* (2013.01); *A47L 9/242* (2013.01); *A47L 9/2805* (2013.01); *A47L 9/2852* (2013.01); *A47L 9/2894* (2013.01); *A47L 9/32* (2013.01); *A47L 5/36* (2013.01); *A47L 2201/04* (2013.01)

(58) Field of Classification Search

CPC ..... A47L 5/362; A47L 9/2884; A47L 9/1409; A47L 9/009; A47L 9/102; A47L 9/242; A47L 9/2852; A47L 9/32; A47L 9/2805; A47L 2201/04; A47L 5/36; A47L 9/28

USPC ..... 15/DIG. 1

See application file for complete search history.

(56) References Cited

U.S. PATENT DOCUMENTS

| | | | |
|---|---|---|---|
| 2,811,737 | A | 11/1957 | Hayba |
| 4,831,683 | A | 5/1989 | Kroll et al. |
| 4,962,453 | A | 10/1990 | Pong et al. |
| 5,839,156 | A | 11/1998 | Park et al. |
| 5,926,909 | A | 7/1999 | McGee et al. |

(Continued)

FOREIGN PATENT DOCUMENTS

| | | |
|---|---|---|
| CN | 1698527 | 11/2005 |
| CN | 101554306 | 10/2009 |

(Continued)

OTHER PUBLICATIONS

Office Action in Australian Application No. 2017226613, dated Nov. 9, 2018, 3 pages.

(Continued)

*Primary Examiner* — David Redding

(74) *Attorney, Agent, or Firm* — Fish & Richardson P.C.

(57) ABSTRACT

A vacuum cleaner includes a cleaner body including a suction motor for generating suction force and a suction part communicating with the cleaner body to suck in air and dust. The cleaner body includes a main body, wheels for moving the main body, and a battery detachably provided at a back side of the main body to supply power to the main body.

21 Claims, 6 Drawing Sheets

(56) References Cited

U.S. PATENT DOCUMENTS

| | | | | |
|---|---|---|---|---|
| 5,991,972 | A | 11/1999 | Krebs et al. | |
| 6,226,830 | B1 | 5/2001 | Hendriks et al. | |
| 7,637,973 | B2 | 12/2009 | Oh et al. | |
| 8,272,854 | B2 | 9/2012 | Castronovo | |
| 8,613,125 | B2 | 12/2013 | Jeong et al. | |
| 9,089,248 | B2 | 7/2015 | Yoo | |
| 9,820,623 | B2 | 11/2017 | Ha | |
| 9,958,031 | B2 | 5/2018 | Park et al. | |
| 2003/0140444 | A1 | 7/2003 | Soejima | |
| 2005/0102790 | A1 | 5/2005 | Matsuno et al. | |
| 2008/0235901 | A1 | 10/2008 | Tanaka et al. | |
| 2010/0132149 | A1 | 6/2010 | Jeong et al. | |
| 2013/0212829 | A1* | 8/2013 | Yoon | A47L 5/36 15/319 |
| 2014/0359967 | A1 | 12/2014 | Park | |
| 2015/0223652 | A1 | 8/2015 | Koura et al. | |
| 2015/0320283 | A1 | 11/2015 | Lee et al. | |
| 2017/0027400 | A1 | 2/2017 | Lee et al. | |
| 2017/0245702 | A1 | 8/2017 | Son et al. | |
| 2017/0245703 | A1 | 8/2017 | Son et al. | |
| 2017/0245704 | A1 | 8/2017 | Son et al. | |
| 2017/0245705 | A1 | 8/2017 | Son et al. | |
| 2017/0245706 | A1 | 8/2017 | Son et al. | |
| 2017/0245707 | A1 | 8/2017 | Son et al. | |
| 2017/0245708 | A1 | 8/2017 | Son et al. | |
| 2017/0245711 | A1 | 8/2017 | Son | |
| 2017/0245712 | A1 | 8/2017 | Son et al. | |
| 2017/0245713 | A1 | 8/2017 | Son et al. | |
| 2017/0245714 | A1 | 8/2017 | Son et al. | |
| 2017/0245715 | A1 | 8/2017 | Son et al. | |
| 2017/0245716 | A1 | 8/2017 | Son et al. | |
| 2017/0245717 | A1 | 8/2017 | Son et al. | |
| 2017/0245719 | A1 | 8/2017 | Son et al. | |
| 2017/0273529 | A1 | 9/2017 | Chung et al. | |
| 2017/0354304 | A1 | 12/2017 | Kwak | |
| 2018/0177360 | A1 | 6/2018 | Kwak | |

FOREIGN PATENT DOCUMENTS

| | | | |
|---|---|---|---|
| CN | 102469901 | | 5/2012 |
| CN | 204169778 | | 2/2015 |
| CN | 204192512 | | 3/2015 |
| CN | 105078363 | | 11/2015 |
| EP | 319700 | A1 | 6/1991 |
| EP | 319700 | B1 | 6/1991 |
| EP | 1674009 | | 6/2006 |
| EP | 1848318 | | 10/2007 |
| EP | 2030543 | | 3/2009 |
| EP | 2063699 | | 6/2009 |
| EP | 2203101 | | 7/2010 |
| JP | H06102061 | | 12/1994 |
| JP | 7236599 | B1 | 9/1995 |
| JP | 11004787 | B1 | 1/1999 |
| JP | 2002028121 | | 1/2002 |
| JP | 2003019095 | | 1/2003 |
| JP | 2003038404 | | 2/2003 |
| JP | 2003093302 | | 4/2003 |
| JP | 2003169771 | | 6/2003 |
| JP | 2004033628 | | 2/2004 |
| JP | 2005-211462 | | 8/2005 |
| JP | 2006263310 | B1 | 10/2006 |
| JP | 2006314569 | A | 11/2006 |
| JP | 2008301851 | B1 | 12/2008 |
| JP | 4553793 | B | 9/2010 |
| JP | 2011177268 | A | 9/2011 |
| JP | 2012192006 | | 10/2012 |
| JP | 2013066620 | | 4/2013 |
| JP | 2015-096132 | | 5/2015 |
| JP | 2015173673 | | 10/2015 |
| JP | 2016015974 | | 2/2016 |
| KR | 199210563 | B1 | 12/1992 |
| KR | 100449933 | | 4/1998 |
| KR | 2006062196 | B1 | 6/2006 |
| KR | 2006074612 | B1 | 7/2006 |
| KR | 100640830 | | 11/2006 |
| KR | 100662282 | | 12/2006 |
| KR | 10-0702733 | | 4/2007 |
| KR | 10-0831784 | | 5/2008 |
| KR | 829094 | B1 | 5/2008 |
| KR | 10-2008-0099370 | | 11/2008 |
| KR | 869537 | B1 | 11/2008 |
| KR | 1020080099373 | | 11/2008 |
| KR | 10-0876695 | | 12/2008 |
| KR | 2010047638 | B1 | 5/2010 |
| KR | 2010116834 | B1 | 11/2010 |
| KR | 2015033554 | B1 | 4/2015 |
| KR | 10-1552437 | | 9/2015 |
| KR | 1666902 | B1 | 10/2016 |
| KR | 2017000071 | B1 | 1/2017 |
| TW | 529406 | | 4/2003 |
| TW | 572746 | | 1/2004 |
| TW | I240622 | | 10/2005 |
| TW | 201402058 | | 1/2014 |
| WO | WO2004032696 | | 4/2004 |
| WO | 2016208944 | A | 12/2016 |

OTHER PUBLICATIONS

Office Action in Australian Application No. 2017227410, dated Nov. 2, 2018, 3 pages.
Office Action in Australian Application No. 2017227411, dated Nov. 6, 2018, 3 pages.
Office Action in U.S. Appl. No. 15/445,018, dated Jul. 10, 2018, 11 pages.
Office Action in U.S. Appl. No. 15/445,325, dated Sep. 25, 2018, 36 pages.
Office Action in U.S. Appl. No. 15/445,456, dated Apr. 11, 2018, 10 pages.
Office Action in U.S. Appl. No. 15/445,493, dated Oct. 15, 2018, 26 pages.
Office Action in U.S. Appl. No. 15/445,494, dated Jul. 12, 2018, 13 pages.
Office Action in U.S. Appl. No. 15/445,508, dated Feb. 22, 2018, 12 pages.
Office Action in U.S. Appl. No. 15/445,289, dated Jan. 28, 2019, 37 pages.
Office Action in U.S. Appl. No. 15/444,742, dated Jan. 28, 2019, 36 pages.
Office Action in U.S. Appl. No. 15/445,379, dated Jan. 28, 2019, 41 pages.
Office Action in U.S. Appl. No. 15/444,761, dated Jan. 31, 2019, 32 pages.
Office Action in U.S. Appl. No. 15/445,326, dated Feb. 8, 2019, 32 pages.
Office Action in U.S. Appl. No. 15/445,214, dated Feb. 8, 2019, 41 pages.

* cited by examiner

VACUUM CLEANER

CROSS-REFERENCE TO RELATED APPLICATION

This application claims priority under 35 U.S.C. 119 and 365 to Korean Patent Application No. 10-2016-0024022, filed on Feb. 29, 2016 in the Korean Intellectual Property Office, the disclosure of which is incorporated herein by reference.

TECHNICAL FIELD

The present invention relates to a vacuum cleaner.

BACKGROUND ART

In general, a vacuum cleaner refers to a device for sucking dust and foreign materials from a surface to be cleaned using a suction motor provided in a main body and filtering dust and foreign materials in the main body.

The vacuum cleaner may be classified into an up-right type vacuum cleaner having a suction nozzle connected to a main body thereof and moving along with the main body and a canister type vacuum cleaner having a suction nozzle connected to a main body through an extension pipe, a handle, a hose, etc.

A vacuum cleaner is disclosed in Korean Patent Publication No. 10-1552437.

The vacuum cleaner of the related art includes a cleaner body including a suction motor for generating suction force, a suction part communicating with the cleaner body to suck in air and dust, a connection part for connecting the suction part and the cleaner body, and a battery provided in the cleaner body to supply power to the suction motor.

Meanwhile, in order to replace the battery or charge the battery using a charger, the battery should be detached from the cleaner body.

However, in the related art, since a battery assembly is provided in the cleaner body, the cleaner body should be disassembled in order to replace or repair a battery assembly, thereby causing user inconvenience.

SUMMARY OF THE INVENTION

An object of the present invention is to provide a vacuum cleaner capable of easily mounting a battery in a cleaner body thereof.

Another object of the present invention is to provide a vacuum cleaner in which a cleaner body is two-point supported by wheels.

Another object of the present invention is to provide a vacuum cleaner capable of improving driving stability of a cleaner body thereof.

Another object of the present invention is to provide a vacuum cleaner for preventing a cleaner body thereof from being overturned backward.

According to an aspect of the present invention, a vacuum cleaner includes a cleaner body including a suction motor. The cleaner body includes a main body, wheels for moving the main body; and a battery detachably provided at a back side of the main body to supply power to the main body. The main body is capable of rotating about a rotation center of the wheels, and, when the battery is detached from the cleaner body, a center of gravity of the main body is located at a front side of a vertical line passing through the rotation center of the wheels.

When the battery is attached to the cleaner body such that the cleaner body is two-point supported by the wheels, the center of gravity of the cleaner body may be located at a back side of the vertical line passing through the rotation center of the wheels.

When the battery is detached from the cleaner body, a front side of a bottom of the main body may contact a floor.

A battery attachment part in which the battery is mounted may be formed at the back side of the main body, and a direction of the battery attached to the battery attachment part may form an acute angle with respect to the vertical line.

The vacuum cleaner may further include a supporter provided on a bottom of the main body to restrict a backward rotation range of the main body, in order to prevent the cleaner body from being overturned backward.

The vacuum cleaner may further include a sensor for sensing motion of the main body and a controller for controlling driving of the wheels by information sensed by the sensor.

When the sensor is turned on, driving of the wheels may be controlled such that the center of gravity of the cleaner body is located on the vertical line passing through the rotation center of the wheels.

When the sensor is turned off, driving of the wheels may be stopped.

BEST MODE

Figure 1:
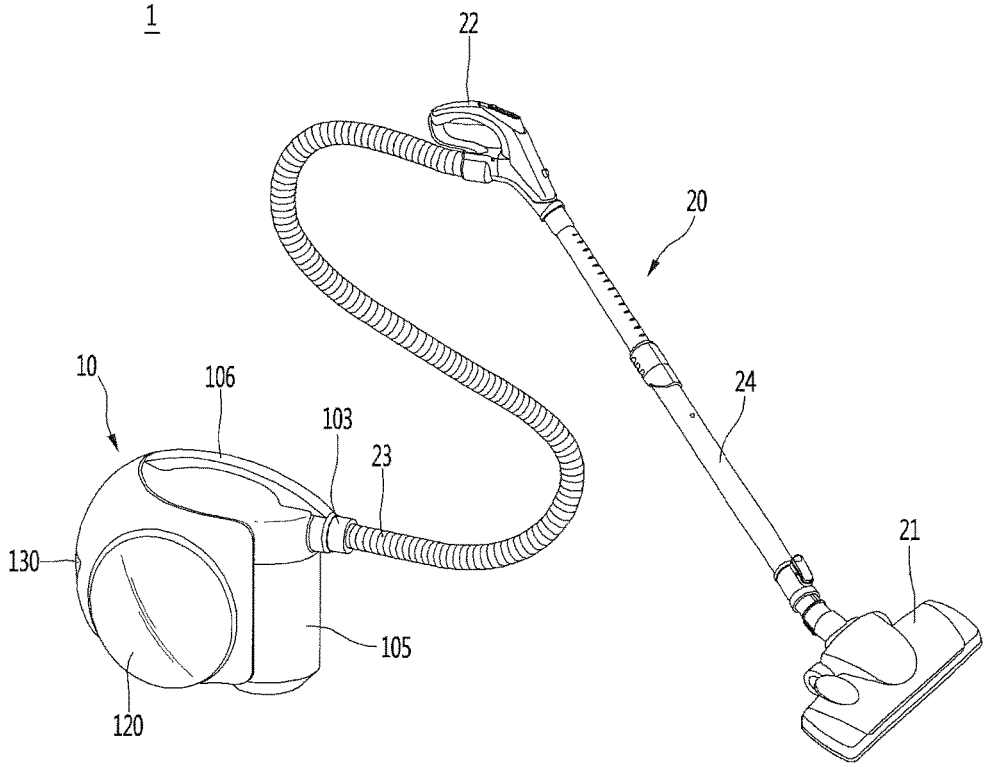
FIG. 1 is a perspective view of a vacuum cleaner according to an embodiment of the present invention.

Hereinafter, the embodiments of the present invention will be described in detail with reference to the accompanying drawings, in which the same or similar portions are denoted by the same reference numerals. In describing the present invention, a detailed description of known functions and configurations will be omitted when it may obscure the subject matter of the present invention.

Hereinafter, the embodiments of the present invention will be described in detail with reference to the accompanying drawings, in which the same or similar portions are denoted by the same reference numerals.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It will be understood that when one element is referred to as being "connected to", "coupled to", or "accessing" another element, one element may be "connected to", "coupled to", or "accessing" another element via a further element although one element may be directly connected to or directly accessing another element.

FIG. 1 is a perspective view of a vacuum cleaner according to an embodiment of the present invention.

Referring to FIG. 1, the vacuum cleaner 1 according to the embodiment of the present invention includes a cleaner body 10 and a suction device 20. The cleaner body 10 includes a suction motor for generating suction force. When the suction motor is driven to generate suction force, the suction device 20 may guide air including dust to the cleaner body 10.

The suction device 20 may include a suction part 21 for sucking dust off a surface to be cleaned, e.g., a floor, and connection parts 22, 23 and 24 for connecting the suction part 21 to the cleaner body 10. The connection parts 22, 23 and 24 may include an extension pipe 24 connected to the suction part 21, a handle 22 connected to the extension pipe 24 and a suction hose 23 for connecting the handle 22 to the cleaner body 10. The cleaner body 10 may include a connector 103 connected to the suction hose 23.

The cleaner body 10 includes a main body 110, wheels 120 and a battery.

The main body 110 includes a dust canister 105 in which dust sucked through the suction device 20 is stored. The dust canister 105 may be detachably mounted in the main body 110. In addition, the dust canister 105 may be provided in front of the main body 110 and may be made of a transparent material to enable a user to view the inside of the dust canister.

The main body 110 may include a grip part 106 gripped by the user. The user may grip the grip part 106 in order to lift up or incline the main body 110.

The vacuum cleaner 1 may include a dust separator (not shown) for separating air and dust sucked by the suction device 20. The dust separator may be provided separately from or integrally with the dust canister 105.

The wheels 120 may be rotatably coupled to the main body 110. The wheels 120 may form a pair and may be coupled to both sides of the main body 110.

The battery 130 may be detachably coupled to the main body 110. If the battery 130 is coupled to the main body 110, the battery 130 may be integral with the main body 110. The battery 130 may move along with the main body 110.

The battery 130 may be responsible for supplying power necessary to drive the vacuum cleaner 1. The battery 130 may be a secondary battery which may be charged or discharged. The battery 130 may be connected with a power cord (not shown) for supplying commercial power.

Figure 2:
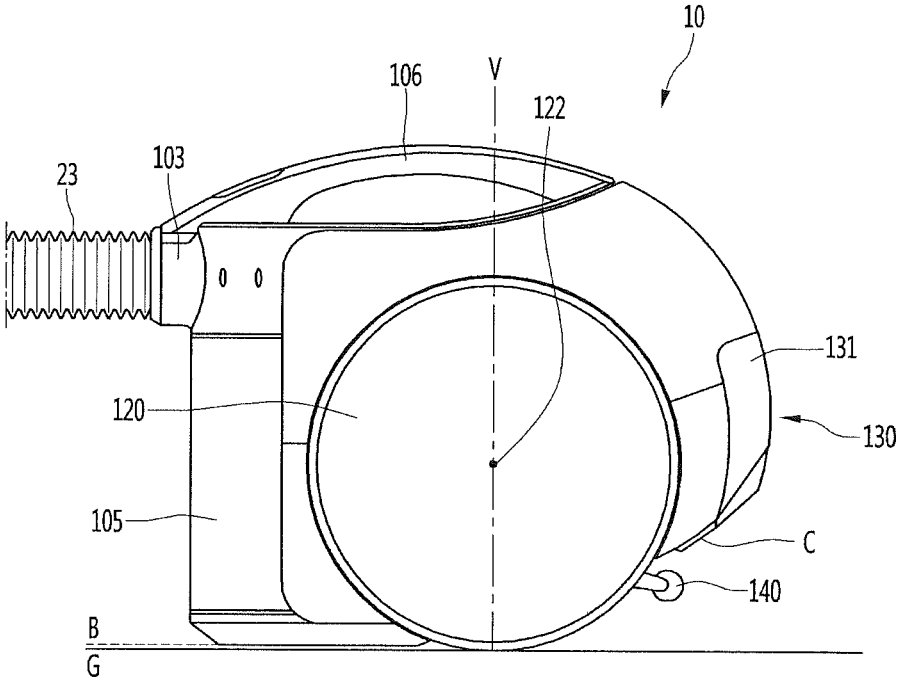
FIG. 2 is a view showing a state in which a main body of FIG. 1 is inclined forward.
Figure 3:
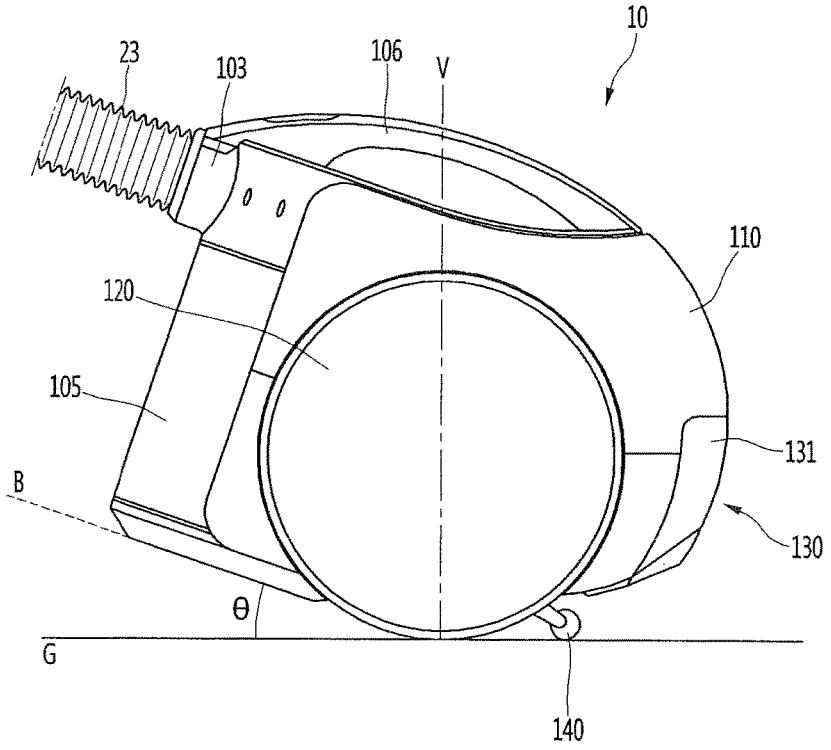
FIG. 3 is a view showing a state in which the main body of FIG. 1 is inclined backward.
Figure 4:
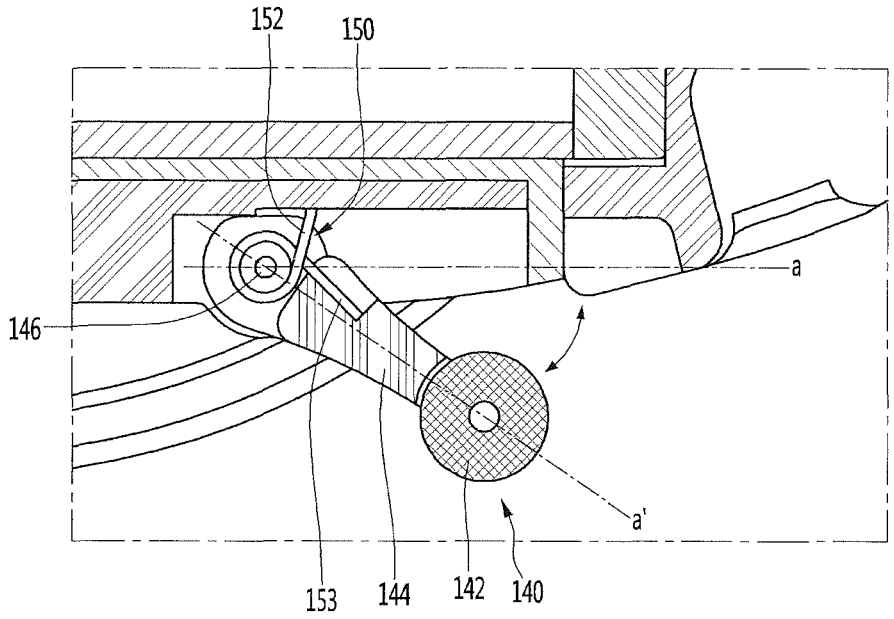
FIG. 4 is a view showing the configuration of a supporter of FIG. 3.

FIG. 2 is a view showing a state in which a cleaner body of FIG. 1 is inclined forward, FIG. 3 is a view showing a state in which the cleaner body of FIG. 1 is inclined backward, and FIG. 4 is a view showing the configuration of a supporter of FIG. 3.

Referring to FIGS. 2 to 4, at least a part of the bottom of the main body 110 is separated from a floor. Thus, the main body 110 may rotate to the front side or the back side of the wheels 120.

A part, in which the connector 103 is provided, of the cleaner body 10 with respect to a vertical line passing through a rotation center of the wheels 120 may be defined as a front side and a part, in which the battery 130 is provided, may be defined as a back side. In addition, the main body 110 rotating forward means that the main body 110 rotates in a counter-clockwise direction (see FIG. 2) in the figure and the main body 110 rotating backward means that the main body 110 rotates in a clockwise direction (see FIG. 3).

The cleaner body 10 may further include a driving unit (not shown) for driving the wheels 120.

The driving unit may be automatically controlled by a controller, such that the wheels 120 may be automatically driven along a direction desired by the user. That is, the controller may perform control such that the cleaner body 10 automatically follows motion of the user.

The cleaner body 10 may further include a sensor (not shown) for sensing motion of the cleaner body 10. The controller may control driving of the wheels 120 by information sensed by the sensor.

As the sensor, a gyro sensor for sensing a current angle and a current speed of the cleaner body upon operating the cleaner body 10 may be used.

The gyro sensor senses angular velocity from the Coriolis force applied in a direction perpendicular to a direction in which a moving object rotates and may measure not only the angle of the moving object but also change in position of the moving object from a first reference point.

If the sensor is turned off, the wheels 120 may not be driven. In this case, the cleaner body 10 is inclined according to the position of the center of gravity thereof. For example, when the center of gravity of the cleaner body 10 is located at the front side of the vertical line V passing through the rotation center 122 of the wheels 120, the cleaner body 10 is inclined forward as shown in FIG. 2 and, when the center of gravity of the cleaner body 10 is located at the back side of the vertical line V, the cleaner body 10 is inclined backward as shown in FIG. 3.

The cleaner body 10 may include a first bottom B and a second bottom C. The second bottom C extends at a predetermined angle with respect to the first bottom B.

In the state shown in FIG. 2, the first bottom B is substantially aligned with the floor G. In contrast, the second bottom C is separated from the floor G and is inclined at a predetermined angle with respect to the floor G.

When the sensor is turned on, the controller may control driving of the wheels 120 such that the center of gravity of the cleaner body 10 is located on the vertical line V passing through the rotation center 122 of the wheels 120.

In this case, as shown in FIG. 3, the first bottom B of the cleaner body 10 may be separated from the floor G.

The cleaner body 10 may further include a supporter 140. The supporter 140 may extend from the second bottom C of the cleaner body 10. The supporter 140 may perform a function for restricting the angle of the cleaner body 10 inclined backward.

The supporter 140 may include an auxiliary wheel 142. The auxiliary wheel 142 may rotate by friction with the floor G. Therefore, the cleaner body 10 may be smoothly driven.

The supporter 140 may further include an extension 144. The auxiliary wheel 142 may be rotatably connected to one side of the extension 144.

The supporter 140 may further include a rotation shaft 146. The other side of the extension 144 may be rotatably connected to the main body 110 by the rotation shaft 146.

The extension 144 may rotate within a predetermined range. More specifically, the extension 144 may rotate upward or downward within a range of a to a'. The main body 110 may include a stopper (not shown) for restricting the rotation range of the extension 144.

The supporter 140 may further include an elastic member 150. For example, the elastic member 150 may be a torsion spring.

One end 152 of the elastic member 150 may be supported by the main body 110 and the other end 153 of the elastic member 150 may be supported by the extension 144. The elastic member 150 may apply elastic force such that the extension 144 rotates in a clockwise direction in the figure.

When the main body 110 is inclined forward to the maximum extent, the front part of the bottom B of the main body 110 may contact the floor G. Thus, the maximum angle of the main body 110 rotated forward may be restricted.

In contrast, when the main body 110 is inclined backward, the supporter 140 may contact the floor G. Thus, the maximum angle of the main body 110 rotated backward may be restricted. Therefore, it is possible to prevent the main body 110 from being overturned forward or backward.

Since elastic force of the elastic member 150 is applied to the extension 140 in a clockwise direction (see FIG. 4) in the figure, when the main body 110 is excessively inclined backward, forward rotation force may be applied to the main body 110 by the supporter 140.

When the main body 110 rotates backward to the maximum extent, the bottom B of the main body 110 forms a predetermined angle θ with respect to the floor G. At this time, the angle θ between the bottom B of the main body 110 and the floor G may be about 17° to 20°.

The battery 130 may include a cover 131. In a state in which the battery 130 is mounted in the main body 110, the cover 131 may be exposed. Thus, the cover 131 may form at least a part of the appearance of the main body 110. In addition, the user may detach the battery 130 from the main body 110 or attach the battery to the main body 110 without disassembling the main body 110. The cover 131 may include a grip part facilitating attachment and detachment of the battery 130 to and from the main body 110.

Hereinafter, a process of attaching and detaching the battery 130 to and from the main body 110 will be described in detail. Hereinafter, assume that the center of gravity of the main body 110 is located at the front side of the main body 110 when the battery 130 is detached from the main body 110 and is located at the back side of the main body 110 when the battery 130 is attached to the main body 110.

Figure 5:
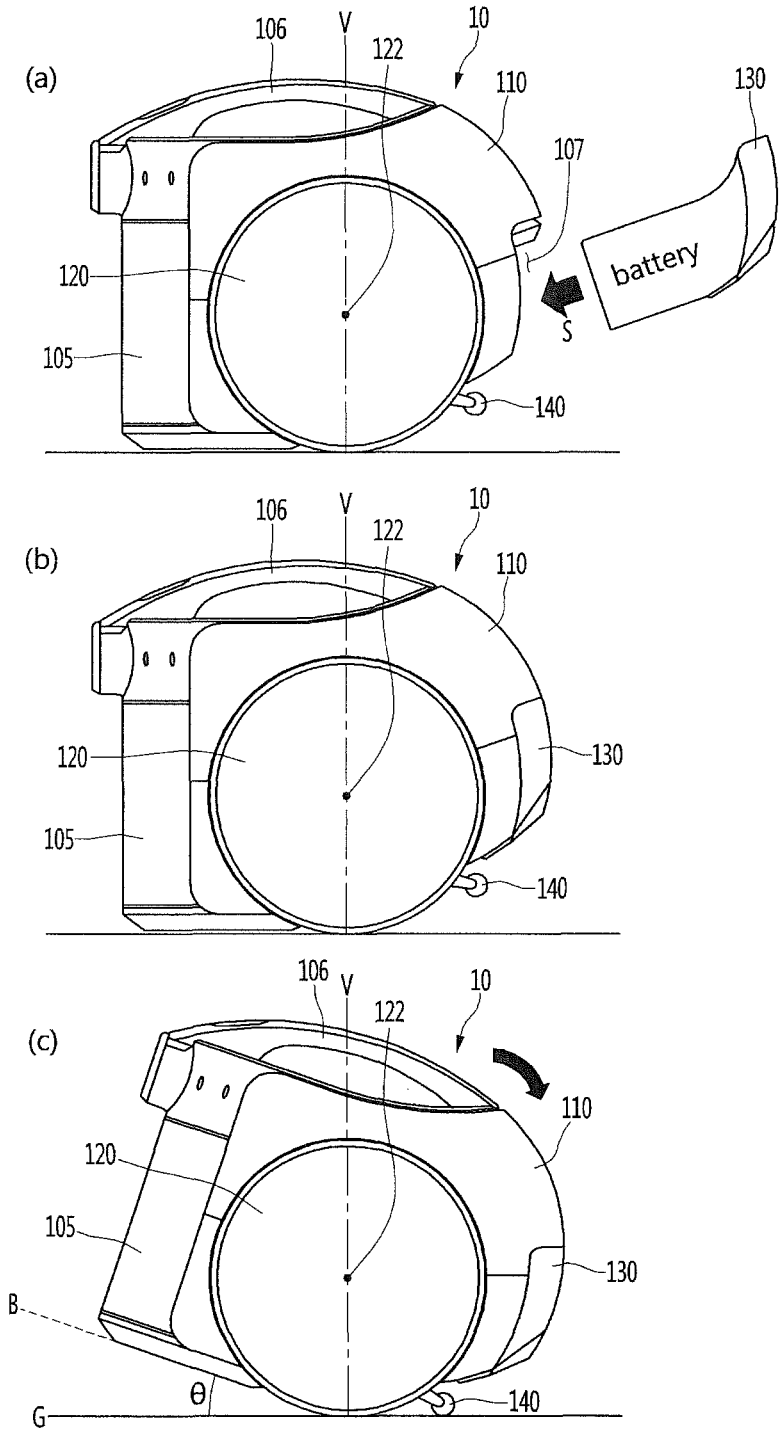
FIG. 5 is a view sequentially showing a state of attaching a battery to the cleaner body of the cleaner.

FIG. 5 is a view sequentially showing a state of attaching a battery to the cleaner body of the cleaner.

(a) of FIG. 5 shows a state in which the battery 130 is detached from the main body 110, (b) of FIG. 5 shows a state in which the battery 130 is attached to the main body 110, and (c) of FIG. 5 shows a state in which the main body 110 is inclined backward.

A battery attachment part 107 coupled with the battery 130 is formed in the main body 110. The battery attachment part 107 may be a recess formed in the main body 110. In addition, an attachment guide (not shown) for guiding attachment of the battery 130 may be formed in the battery attachment part 107.

The battery attachment part 107 is formed at the lower side of the main body 110 and thus the battery 130 is attached to the lower side of the main body 110. The center of gravity of the battery 130 may be located at the lower side of the rotation center of the wheels 120 in a state in which the battery 130 is mounted in the main body 110.

Accordingly, when the battery 130 is attached to the main body 110, the center of gravity of the main body 110 may be moved downward, it is possible to improve driving stability of the cleaner body 10.

When the battery 130 is attached to the lower side of the main body 110, it is possible to improve driving stability. However, since the battery 130 is attached to the lower side of the main body 110, user inconvenience may be caused upon attaching the battery 130.

However, in a state in which the battery 130 is detached from the main body 110, the center of gravity of the main body 110 may be located at the front side of the vertical line passing through the center of the wheels 120. Therefore, when the battery 130 is detached from the main body 110, the main body 110 may be inclined to the front side of the wheels 120.

As the main body 110 is inclined forward, the front side of the bottom of the main body 110 contacts the floor. At this time, the battery attachment part 107 is inclined upward. Therefore, the user may easily attach the battery 130.

The battery 130 may be obliquely attached to the main body 110 by the attachment guide provided in the battery attachment part 107. More specifically, the insertion direction S of the battery 130 may form an acute angle with respect to the vertical direction V and the floor. Accordingly, when the front side of the bottom of the main body 110 contacts the floor, the insertion direction S of the battery 130 forms an acute angle with respect to the floor.

When the battery 130 is attached to the main body 110, the center of gravity of the main body 110 may move backward. That is, in a state in which the battery 130 is attached to the main body 110, the center of gravity of the main body 110 may be located at the back side of the vertical direction passing through the center of the wheels 120.

That is, when the battery 130 is attached to the main body 110, the main body 110 may be inclined to the back side of the wheels 120. At this time, the supporter 140 may selectively contact the floor. At this time, the bottom B of the main body 110 forms a predetermined angle θ with respect to the floor G.

Figure 6:
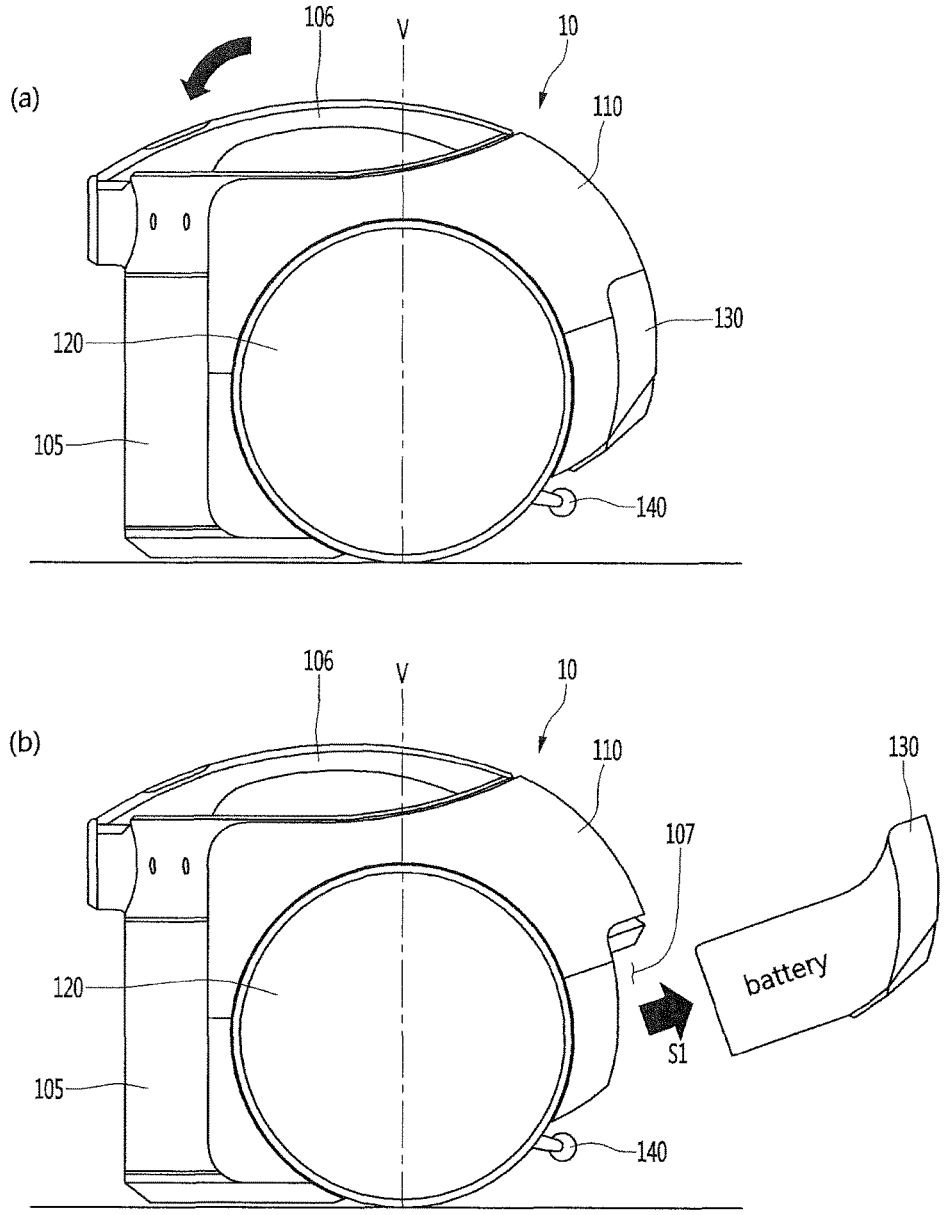
FIG. 6 is a view sequentially showing a state of detaching a battery from the cleaner body of the cleaner.

FIG. 6 is a view sequentially showing a state of detaching a battery from the cleaner body of the cleaner.

More specifically, (a) of FIG. 6 shows a state before the battery 130 is detached from the main body and (b) of FIG. 6 is a state after the battery 130 is detached from the main body 110.

In order to detach the battery 130 from the main body 110, the user may directly apply force to the main body 110 to incline the main body 110 forward. Next, the user may detach the battery 130 in a direction opposite to the insertion direction S. The user may grip the grip part 106 and then apply force forward in order to incline the main body 110 forward.

When the battery 130 is detached from the main body 110, the center of gravity of the main body 110 moves forward. Therefore, the main body 110 may be maintained in a forward inclined state.

In the vacuum cleaner 1 of the present invention, in the state in which the battery 130 is mounted in the main body 110, the main body 110 rotates backward such that the bottom of the main body 110 is separated from the floor. That is, the main body 110 may be two-point supported by the wheels 120. In this case, since the cleaner body 10 easily passes an obstacle and friction applied to the wheels 120 is reduced, it is possible to reduce user labor required to move the main body 10.

When the battery 130 is detached from the main body 110, the center of gravity of the main body 110 moves forward to rotate forward and thus the battery attachment part 107 provided at the lower back side of the main body 110 is raised. Therefore, the user can easily attach the battery 130 to the battery attachment part 107.

The invention claimed is:

1. A vacuum cleaner comprising:

a cleaner body including a suction motor, the suction motor being configured to generate suction force; and a suction part in communication with the cleaner body and configured to suction air and dust, wherein the cleaner body further includes:

a main body, wheels for moving the main body, and a battery that is detachably provided at a back side of the main body and configured to supply power to the main body, wherein the main body is configured to rotate about a rotation center of the wheels, wherein, based on the battery being detached from the cleaner body, a center of gravity of the main body is located forward of a vertical extension line passing through the rotation center of the wheels, wherein, based on the battery being attached to the cleaner body, the center of gravity of the cleaner body is located rearward of the vertical extension line passing through the rotation center of the wheels, and wherein, based on the battery being attached to the cleaner body, a center of gravity of the battery is located vertically lower than the rotation center of the wheels.

2. The vacuum cleaner according to claim 1, wherein, based on the battery being detached from the cleaner body, a front side of a bottom of the main body is configured to contact a floor on which the cleaner body is placed.

3. The vacuum cleaner according to claim 1, wherein a battery attachment part into which the battery is inserted is defined at the back side of the main body, and wherein an insertion direction of the battery into the battery attachment part forms an acute angle with respect to the vertical extension line.

4. The vacuum cleaner according to claim 3, wherein the insertion direction of the battery into the battery attachment part forms an acute angle with a floor on which the cleaner body is placed.

5. The vacuum cleaner according to claim 3, wherein the battery includes a battery cover that is configured, based on the battery being mounted within the battery attachment part, to cover the battery attachment part.

6. The vacuum cleaner according to claim 1, further comprising a supporter provided on a bottom of the main body and configured to restrict a backward rotation range of the main body.

7. The vacuum cleaner according to claim 6, wherein the supporter includes an auxiliary wheel that is configured to rotate based on contacting a floor.

8. The vacuum cleaner according to claim 6, wherein the supporter includes an extension, one side of the extension being rotatably connected to the main body.

9. The vacuum cleaner according to claim 8, wherein the supporter includes an elastic member that is configured to provide an elastic force to the extension.

10. The vacuum cleaner according to claim 1, further comprising:

a sensor configured to sense a motion of the main body; and a controller configured to cause the wheels to be driven according to information sensed by the sensor.

11. The vacuum cleaner according to claim 10, wherein the controller is configured, based on the sensor being turned on, to control the driving of the wheels such that the center of gravity of the cleaner body is located along the vertical extension line passing through the rotation center of the wheels.

12. The vacuum cleaner according to claim 10, wherein the controller is configured, based on the sensor being turned off, to cause the wheels to stop driving.

13. The vacuum cleaner according to claim 10, further comprising a driving unit configured to drive the wheels, wherein the controller controls the driving unit.

14. The vacuum cleaner according to claim 10, wherein, based on the battery being detached from the cleaner body and the sensor being turned off, the center of gravity of the main body is located forward of the vertical extension line.

15. The vacuum cleaner according to claim 1, wherein a dust canister for storing dust suctioned through the suction part is provided at a front portion of the main body.

16. The vacuum cleaner according to claim 1, wherein a grip part configured to be gripped by a user is provided on the main body.

17. The vacuum cleaner according to claim 10, wherein the controller controls the wheels of the cleaner body to automatically follow a movement of a user.

18. The vacuum cleaner according to claim 1, wherein a bottom of the cleaner body includes a first bottom and a second bottom that are respectively inclined at a predetermined angle with respect to the first bottom, wherein, based on the battery being detached from the cleaner body, the first bottom is configured to contact a floor and the second bottom is configured to be separated from the floor, and wherein, based on the battery being mounted within the cleaner body, the first bottom is configured to be separated from the floor and the second bottom is configured to contact the floor.

19. A vacuum cleaner comprising:

a cleaner body including a suction motor, the suction motor being configured to generate suction force; and a suction part in communication with the cleaner body and configured to suction air and dust, wherein the cleaner body further includes:

a main body, wheels for moving the main body, and a battery that is detachably provided at a back side of the main body and configured to supply power to the main body, wherein the main body is configured to rotate about a rotation center of the wheels, wherein, based on the battery being detached from the cleaner body, a center of gravity of the main body is located forward of a vertical extension line passing through the rotation center of the wheels, wherein, based on the battery being attached to the cleaner body, the center of gravity of the cleaner body is located rearward of the vertical extension line passing through the rotation center of the wheels, wherein the cleaner body is configured to, based on the cleaner body being moved in a forward traveling direction by the wheels, rotate about the rotation center of the wheels in a first direction such that the battery becomes farther from ground based on the cleaner body travelling in the forward traveling direction as compared to the cleaner body being stationary, and wherein, based on the battery being attached to the cleaner body, a center of gravity of the battery is located vertically lower than the rotation center of the wheels.

20. The vacuum cleaner according to claim 19, further comprising one or more auxiliary wheels positioned rearward of the wheels, wherein the one or more auxiliary wheels are configured to, based on the cleaner body being stationary, contact ground, and configured to, based on the vacuum cleaner travelling in the forward traveling direction, become separated from ground.

21. The vacuum cleaner according to claim 19, wherein the suction part is located at a front side of the cleaner body based on the cleaner body travelling in the forward traveling direction.

* * * * *